US010300338B2

(12) United States Patent
Chen

(10) Patent No.: US 10,300,338 B2
(45) Date of Patent: May 28, 2019

(54) QUICK FOLDING AGILITY LADDER

(71) Applicant: Jenkins Asia Tech (Shanghai) Limited, Shanghai (CN)

(72) Inventor: Weng Kin Chen, Shanghai (CN)

(73) Assignee: Jenkins Asia Tech (Shanghai), Shanghai (CN)

( * ) Notice: Subject to any disclaimer, the term of this patent is extended or adjusted under 35 U.S.C. 154(b) by 37 days.

(21) Appl. No.: 15/454,873

(22) Filed: Mar. 9, 2017

(65) Prior Publication Data

US 2017/0291070 A1 Oct. 12, 2017

Related U.S. Application Data

(60) Provisional application No. 62/319,735, filed on Apr. 7, 2016.

(51) Int. Cl.

| | |
|---|---|
| ***A63B 26/00*** | (2006.01) |
| ***A63B 23/04*** | (2006.01) |
| ***A63B 69/00*** | (2006.01) |

(52) U.S. Cl.

CPC ..... *A63B 26/003* (2013.01); *A63B 23/0464* (2013.01); *A63B 69/0028* (2013.01); *A63B 2209/00* (2013.01); *A63B 2209/08* (2013.01); *A63B 2209/10* (2013.01); *A63B 2210/50* (2013.01)

(58) Field of Classification Search

CPC ..... A63B 23/0464; A63B 26/003; A63B 69/0028; A63B 2210/50

See application file for complete search history.

(56) References Cited

U.S. PATENT DOCUMENTS

| | | | | |
|---|---|---|---|---|
| 8,328,696 | B2 * | 12/2012 | Dieter | A63B 23/0464 473/414 |
| 8,579,768 | B2 * | 11/2013 | Prstojevich | A63B 23/0464 482/14 |
| 9,855,453 | B2 * | 1/2018 | Day | A63B 5/22 |
| 2006/0247100 | A1 * | 11/2006 | Harker | A63B 5/16 482/23 |
| 2008/0227608 | A1 * | 9/2008 | Sapia | A63B 19/00 482/110 |
| 2015/0099609 | A1 * | 4/2015 | White | A63B 17/00 482/23 |
| 2016/0296803 | A1 * | 10/2016 | Day | A63B 5/22 |
| 2017/0072240 | A1 * | 3/2017 | Wu | A63B 5/16 |
| 2017/0246505 | A1 * | 8/2017 | Rains | A63B 23/0458 |
| 2017/0246823 | A1 * | 8/2017 | Otting | B29D 30/54 |
| 2018/0099171 | A1 * | 4/2018 | Chen | A63B 5/16 |

* cited by examiner

*Primary Examiner* — Megan Anderson
(74) *Attorney, Agent, or Firm* — Levine Bagade Han LLP

(57) ABSTRACT

A quick folding agility ladder and methods of folding and opening the agility ladder are disclosed. In one embodiment, the quick folding agility ladder can comprise a plurality of rectangular ladder frames and a plurality of ladder rung sleeves connecting the rectangular ladder frames. The plurality of ladder rung sleeves can comprise a first rung sleeve and a second rung sleeve. The agility ladder can be folded into a quadrifolium configuration comprising four petal-shaped portions including a first petal-shaped portion, a second petal-shaped portion, a third petal-shaped portion, and a fourth petal-shaped portion. The first rung sleeve can form at least part of the first petal-shaped portion and the fourth petal-shaped portion and the second rung sleeve can form at least part of the second petal-shaped portion and the third petal-shaped portion.

20 Claims, 9 Drawing Sheets

STEP 1

STEP 2

STEP 3

STEP 4

QUICK FOLDING AGILITY LADDER

RELATED APPLICATIONS

This application is a non-provisional of U.S. Provisional Application No. 62/319,735 filed Apr. 7, 2016, the entirety of which is incorporated by reference.

FIELD OF TECHNOLOGY

The present disclosure relates generally to the field of exercising equipment for agility training, and, more specifically, to a quick folding agility ladder.

BACKGROUND

Training with agility ladders has become a common and popular training technique for professional and amateur athletes. Traditional agility ladders usually consist of a rope or polymer fiber ladder with plastic or metal parts serving as ladder rungs or covering portions of such rungs. Such traditional agility ladders are usually beset by several disadvantages or shortcomings including a tendency to get tied up or twisted into knots and other hard to unravel configurations. A user or trainer often spends up to several minutes unraveling or unfurrowing such agility ladders which can reduce the appeal of this type of equipment for busy athletes or trainees. Moreover, once such a training session is completed, the user or trainer must then meticulously collapse or fold the ladder in order not to introduce hard to untangle knots or twists into the ladder. Therefore, a solution is needed which makes unraveling or opening and collapsing or folding such agility ladders quick and simple.

SUMMARY

A quick folding agility ladder is disclosed. In one embodiment, the agility ladder can comprise a plurality of rectangular ladder frames connected by a plurality of ladder rung sleeves. The plurality of rectangular ladder frames comprises between four ladder frames and ten ladder frames. In one embodiment, the plurality of rectangular ladder frames can be square-shaped ladder frames. Each of the plurality of rectangular ladder frames can also have four rounded corners. The agility ladder can be foldable into a stacked structure where the plurality of rectangular ladder frames are stacked on top of one another.

The plurality of rectangular ladder frames can comprise at least a first ladder frame, a second ladder frame, and a third ladder frame. The plurality of ladder rung sleeves can also comprise a first rung sleeve and a second rung sleeve. The first rung sleeve can connect the first ladder frame to the second ladder frame. The second rung sleeve can connect the second ladder frame to the third ladder frame. The plurality of ladder rung sleeves can be made from a synthetic fabric.

Each of the plurality of ladder rung sleeves can comprise a rung lumen. In addition, the first ladder frame can comprise a first ladder rung side and the second ladder frame can comprise a second ladder rung side. The first rung sleeve can connect the first ladder frame to the second ladder frame when at least part of the first ladder rung side and at least part of the second ladder rung side are within the rung lumen of the first rung sleeve. The first ladder frame can be rotatable relative to the second ladder frame when the first rung sleeve connects the first ladder frame to the second ladder frame.

The agility ladder can have a quadrifolium configuration when the agility ladder is folded. The quadrifolium configuration can comprise four petal-shaped portions including a first petal-shaped portion, a second petal-shaped portion, a third petal-shaped portion, and a fourth petal-shaped portion. The first petal-shaped portion can be substantially diagonal to the second petal-shaped portion. The third petal-shaped portion can be substantially diagonal to the fourth petal-shaped portion. The first rung sleeve can form at least part of the first petal-shaped portion and at least part of the fourth petal-shaped portion. The second rung sleeve can form at least part of the second petal-shaped portion and at least part of the third petal-shaped portion. Each of the ladder frames can comprise a first lateral side and a second lateral side opposite the first lateral side. In one example embodiment, the first lateral side can form at least part of the first petal-shaped portion and at least part of the third petal-shaped portion.

Each of the plurality of rectangular ladder frames can comprise a flexible wire frame covered by a frame sleeve. In one embodiment, the flexible wire frame can be a metallic frame. For example, the flexible wire frame can be one continuous steel wire shaped as a rectangle. As a more specific example, the one continuous steel wire can be high carbon steel wire. In other embodiments, the flexible wire frame can be a polymeric frame having shape memory characteristics.

The flexible wire frame can have a wire diameter. In some embodiments, the wire diameter can be between 1.5 mm to 2.0 mm.

In one embodiment, the frame sleeve can be made from a fabric such as a synthetic fabric or a natural fabric. The frame sleeve can have a sleeve frame lumen and the flexible wire frame can be within the sleeve frame lumen such that the frame sleeve encases the flexible wire frame.

Each of the plurality of rectangular ladder frames can have a frame diagonal length and the agility ladder in the quadrifolium configuration can have a quadrifolium diagonal length. A ratio of the frame diagonal length to the quadrifolium diagonal length can be between approximately 1.4:1 to 1.6:1. Each of the plurality of rectangular ladder frames can have a frame side length and the agility ladder in the quadrifolium configuration can have a quadrifolium height. A ratio of the frame side length to the quadrifolium height can be between approximately 1.5:1 to 1.8:1.

A method of folding an agility ladder is also disclosed. In one embodiment, the method can comprise folding a plurality of rectangular ladder frames into a stacked structure. The stacked structure can comprise a first stacked corner and a second stacked corner diagonal to the first stacked corner. The method can also comprise twisting the first stacked corner in a first rotational direction and simultaneously holding the second stacked corner steady or twisting the second stacked corner in a second rotational direction opposite the first rotational direction to fold the agility ladder into a quadrifolium configuration. The method can further comprise bringing the first stacked corner closer to the second stacked corner to further fold the agility ladder into the quadrifolium configuration.

A method of opening an agility ladder is also disclosed. In one embodiment, the method can comprise providing the agility ladder. The agility ladder can comprise a plurality of rectangular ladder frames and a plurality of ladder rung sleeves connecting the plurality of rectangular ladder frames to one another. The agility ladder can have a quadrifolium configuration when the agility ladder is folded. The quadrifolium configuration can comprise four petal-shaped portions including at least a first petal-shaped portion and a second petal-shaped portion. The method can also comprise twisting the first petal-shaped portion in a first rotational direction and simultaneously holding the second petal-shaped portion steady or twisting the second petal-shaped portion in a second rotational direction opposite the first rotational direction.

DETAILED DESCRIPTION

Figure 1:
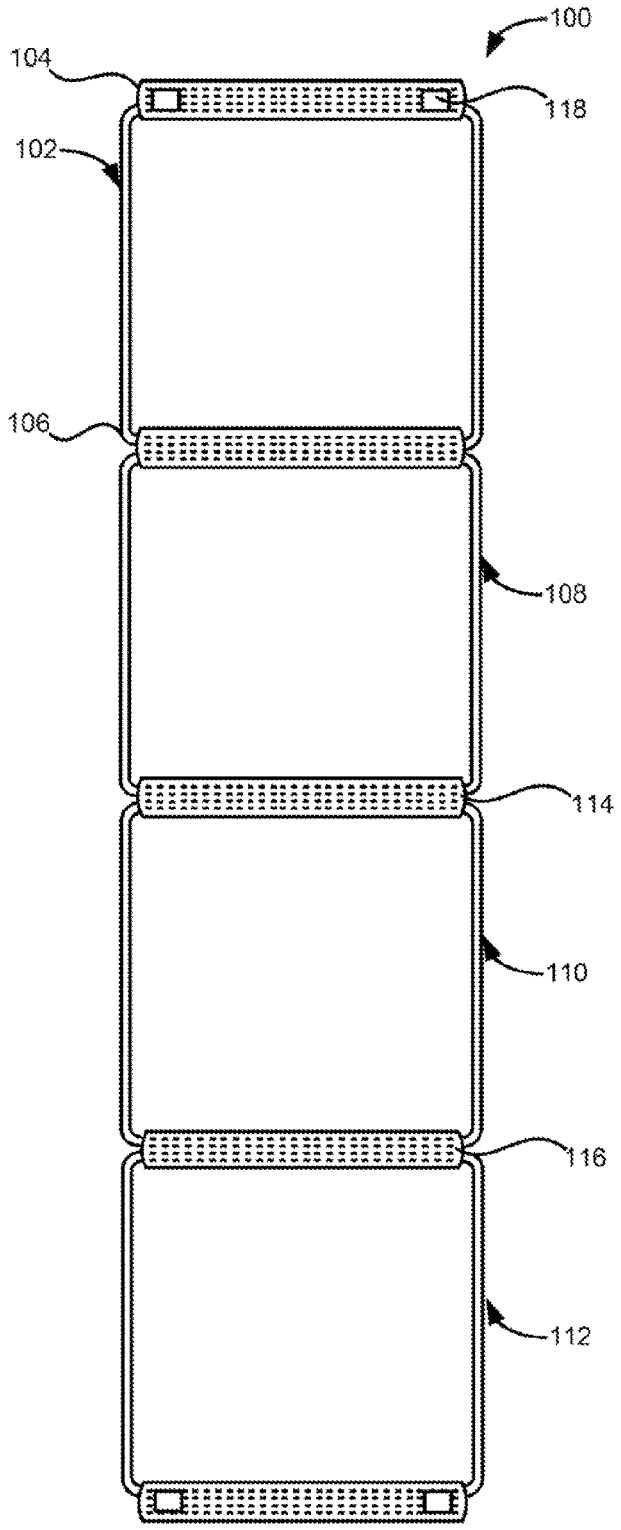
FIG. 1 illustrates an embodiment of an agility ladder in a ladder configuration.

FIG. 1 illustrates an embodiment of an agility ladder 100 unfolded into a ladder configuration. The agility ladder 100 can comprise a plurality of rectangular ladder frames 102 connected by a plurality of ladder rung sleeves 104. For example, FIG. 1 depicts an embodiment of the agility ladder 100 having four rectangular ladder frames 102. In other embodiments, the agility ladder 100 can have between five and ten rectangular ladder frames 102.

In the embodiment shown in FIG. 1, the plurality of rectangular ladder frames 102 can be square-shaped ladder frames having sides of substantially equal length. In other embodiments, the sides of the rectangular ladder frames 102 can vary in length. As shown in FIG. 1, each of the plurality of rectangular ladder frames 102 can also have four rounded corners 106.

Although not shown in the figures, it is contemplated by this disclosure that in certain embodiments, the agility ladder 100 can have ladder frames shaped substantially as trapezoids, parallelograms, or rhombi. In these and other embodiments, the ladder frames can all be substantially of the same size. In other embodiments contemplated by this disclosure, the size of the ladder frames can vary.

The plurality of rectangular ladder frames 102 can comprise at least a first ladder frame 108, a second ladder frame 110, and a third ladder frame 112. The first ladder frame 108, the second ladder frame 110, and the third ladder frame 112 can refer to any neighboring or adjacent rectangular ladder frames 102 making up the agility ladder 100.

In addition, the plurality of ladder rung sleeves 104 can comprise at least a first rung sleeve 114 and a second rung sleeve 116. The first rung sleeve 114 can connect the first ladder frame 108 to the second ladder frame 110. The second rung sleeve 116 can connect the second ladder frame 110 to the third ladder frame 112.

The agility ladder 100 can also comprise one or more attachment mechanisms 118 positioned on an outer surface of the ladder rung sleeves 104 at the terminal ends of the agility ladder 100. The attachment mechanisms 118 can allow one agility ladder 100 to connect to another agility ladder 100 resulting in a longer combined agility ladder. The attachment mechanisms 118 can also allow one terminal end of the agility ladder 100 to couple to another terminal end of the same agility ladder 100. For example, the attachment mechanisms 118 can allow one terminal end of the agility ladder 100 to couple to another terminal end of the same agility ladder 100 when the ladder is folded into a stacked structure 200 (see FIG. 2B). In one embodiment, the attachment mechanisms 118 can be hook-and-loop fasteners such as Velcro®. In other embodiments, the attachment mechanisms 118 can be snap buttons, clips, clasps, traditional buttons, or a combination thereof. In yet additional embodiments, the attachment mechanisms 118 can be a zipper type attachment.

Figure 2A:
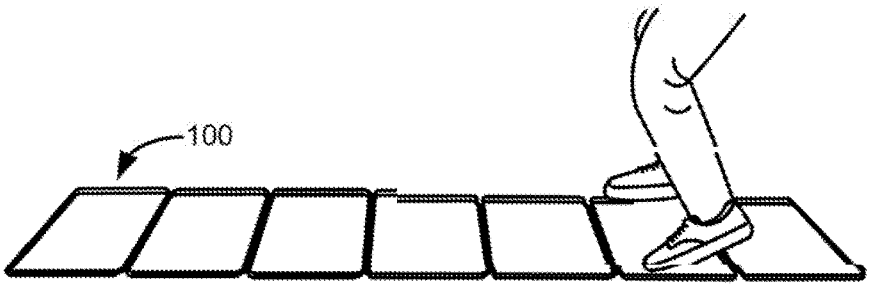
FIG. 2A illustrates an embodiment of the agility ladder in operation.

FIG. 2A illustrates an embodiment of the agility ladder 100 in operation. In the embodiment shown in FIG. 2A, the agility ladder 100 can have seven rectangular ladder frames 102. As shown in FIG. 2A, the agility ladder 100 can be laid on the ground or on a training surface such as turf or grass. Although not shown in FIG. 2A, the agility ladder 100 can also be raised off the ground by being set on stakes or vertical supports. The agility ladder 100 can have openings, clips, magnets, or hook-and-loop fasteners such as Velcro® positioned along the lateral sides of the agility ladder 100 in order to couple or connect the agility ladder 100 to such stakes or vertical supports.

A user can increase his or her lateral range of motion and lateral speed by training with the agility ladder 100. The user can jump, shuffle, side-step, hop, or run through or around the agility ladder 100 in order to enhance his or her lateral range of motion and speed or strengthen his or her lower extremities.

Figure 2B:
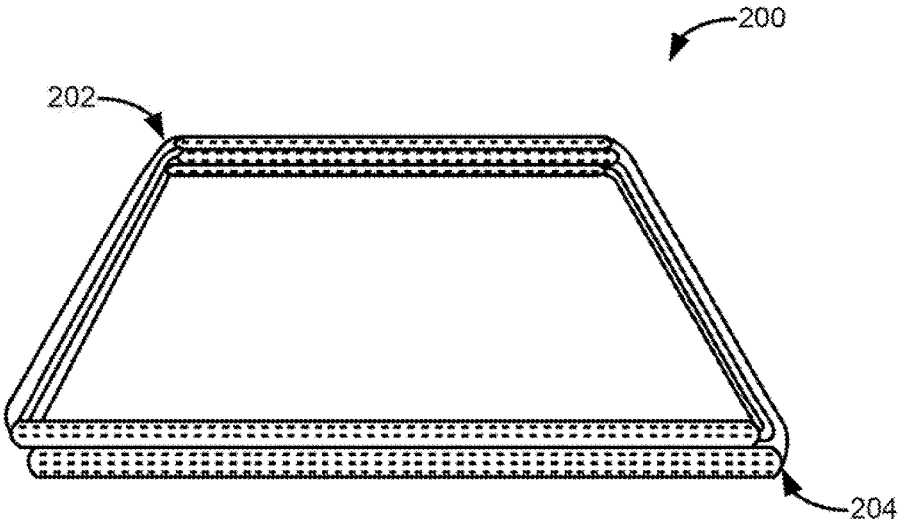
FIG. 2B illustrates an embodiment of the agility ladder folded into a stacked structure.

FIG. 2B illustrates an embodiment of the agility ladder 100 folded into a stacked structure 200. The agility ladder 100 can be folded into the stacked structure 200 when the plurality of rectangular ladder frames 102 are stacked on top of one another. The rectangular ladder frames 102 are rotatable within the ladder rung sleeves 104. This allows the plurality of rectangular ladder frames 102 to align and form the stacked structure 200. As shown in FIG. 2B, the stacked structure 200 can comprise a first stacked corner 202 and a second stacked corner 204 diagonal to the first stacked corner 202. The first stacked corner 202 and the second stacked corner 204 will be discussed in more detail in the sections that follow concerning the folding of the agility ladder 100.

Figure 3A:
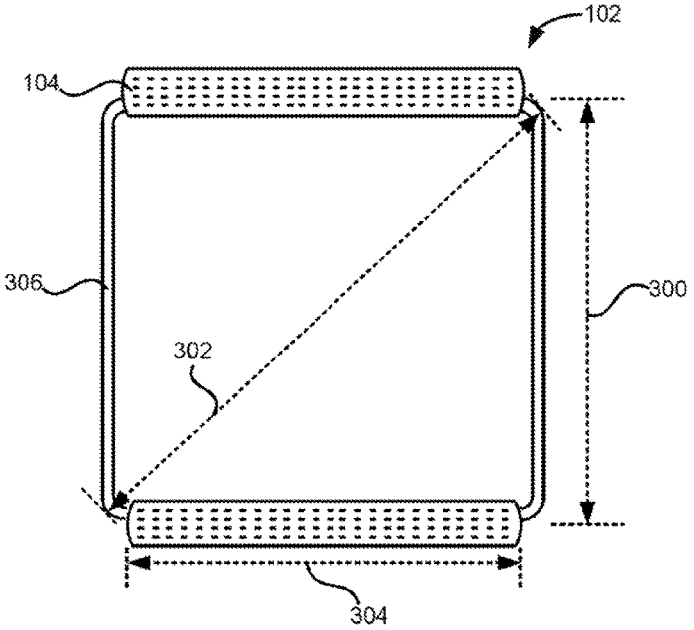
FIG. 3A illustrates an embodiment of a rectangular ladder frame and a pair of ladder rung sleeves coupled to the rectangular ladder frame.

FIG. 3A illustrates an embodiment of a rectangular ladder frame 102 and a pair of ladder rung sleeves 104 wrapped around opposing sides of the rectangular ladder frame 102. The rectangular ladder frame 102 shown in FIG. 3A can be any of the plurality of rectangular ladder frames 102 making up the agility ladder 100.

In one embodiment, the ladder rung sleeves 104 can be made of fabric. For example, the fabric can be or comprise a polymeric fabric such as nylon, heavy-duty nylon, ballistic nylon, coated nylon, polyester, elastane, latex, or a combination thereof. In other embodiments, the ladder rung sleeves 104 can be made of any fabric composed of strands or filaments having a linear mass density of between 800-denier to 1000-denier. For example, the ladder rung sleeves 104 can be made of Cordura® nylon fabric. As a more specific example, the ladder rung sleeves 104 can be made of 1000-denier (1000D) Cordura® nylon fabric. The ladder rung sleeves 104 can be shaped substantially as tubes or rectangular shaped sleeves having a hollow interior or a rung lumen 408 (see FIG. 4A). The ladder rung sleeves 104 can be formed from one piece of fabric rolled into a tube or folded into two elongate rectangular pieces of fabric where at least one side of the tube or rectangular sleeve is sewn together. In one embodiment, the ladder rung sleeves 104 can be sewn using nylon thread such as 420-denier nylon thread.

As shown in FIG. 3A, the rectangular ladder frame 102 can have a frame side length 300 and a frame diagonal length 302. In some embodiments, the frame side length 300 can be between approximately 380 mm and 450 mm. In one example embodiment, the frame side length 300 can be approximately 400 mm. In this and other embodiments, the frame diagonal length 302 can be between approximately 530 mm and 640 mm. In one example embodiment, the frame diagonal length 302 can be approximately 565 mm.

FIG. 3A also illustrates that each of the ladder rung sleeves 104 can have a rung length 304. The rung length 304 can be less than the frame side length 300. For example, in some embodiments, the rung length 304 can be between approximately 350 mm and 390 mm when the frame side length 300 is between approximately 380 mm and 450 mm. In one embodiment, the rung length 304 can be approximately 380 mm when the frame side length 300 is approximately 400 mm.

Figure 3B:
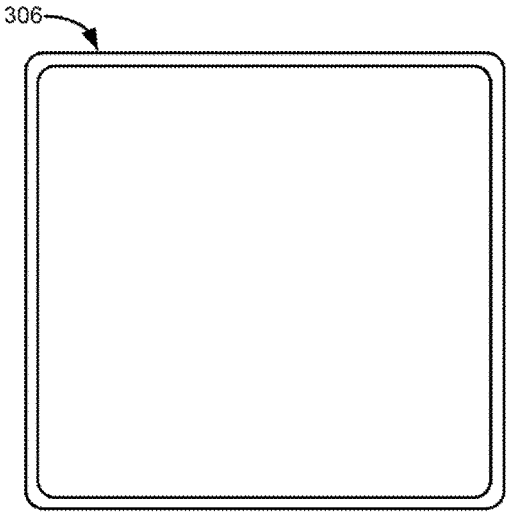
FIG. 3B illustrates an embodiment of a frame sleeve.

FIG. 3B illustrates an embodiment of a frame sleeve 306 serving as part of the rectangular ladder frame 102. The frame sleeve 306 can be a fabric sleeve or cover encasing a flexible wire frame 308 (see FIG. 3C). The frame sleeve 306 can have a frame sleeve lumen 410 (see FIG. 4B) and the flexible wire frame 308 can be contained within the frame sleeve lumen 410. In one embodiment, the frame sleeve 306 can be made of a light-weight fabric such as cotton. In other embodiments, the frame sleeve 306 can be made of a synthetic fabric such as nylon fabric. The frame sleeve 306 can be sewn into a substantially rectangular shape or a shape matching the flexible wire frame 308.

Figure 3C:
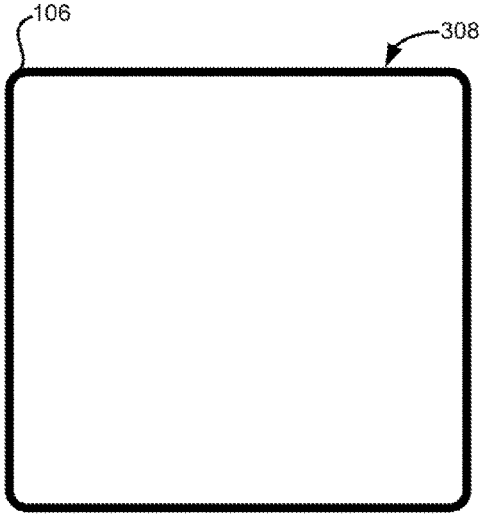
FIG. 3C illustrates an embodiment of a flexible wire frame serving as part of the rectangular ladder frame.

FIG. 3C illustrates an embodiment of a flexible wire frame 308 serving as part of the rectangular ladder frame. The flexible wire frame 308 can be housed or completely encased by the frame sleeve 306. In one embodiment, the flexible wire frame 308 can be a metallic fame. In this embodiment, the flexible wire frame 308 can be made from or comprise one continuous steel wire shaped as a rectangle.

In one embodiment, the flexible steel wire can comprise high-carbon steel wire. Moreover, the flexible steel wire can be made of stainless steel or steel wire coated with zinc. For example, the flexible steel wire can be 60# steel wire. In other embodiments, the flexible wire frame 308 can comprise or be made from a shape memory material such as Nitinol® (nickel titanium) or other types of shape memory alloys or shape memory polymers.

FIG. 3C also shows that the flexible wire frame 308 can be substantially shaped as a rectangle having rounded corners 106 or radiused corners. The rounded corners 106 facilitate the folding of the agility ladder 100 from the stacked structure 200 into the quadrifolium configuration 512 (see FIG. 5D and FIGS. 6A to 6C). The rounded corners 106 also contribute to the safety of the agility ladder 100 by preventing the agility ladder 100 from having sharp petal tips when folded into the quadrifolium configuration 512.

Figure 4A:
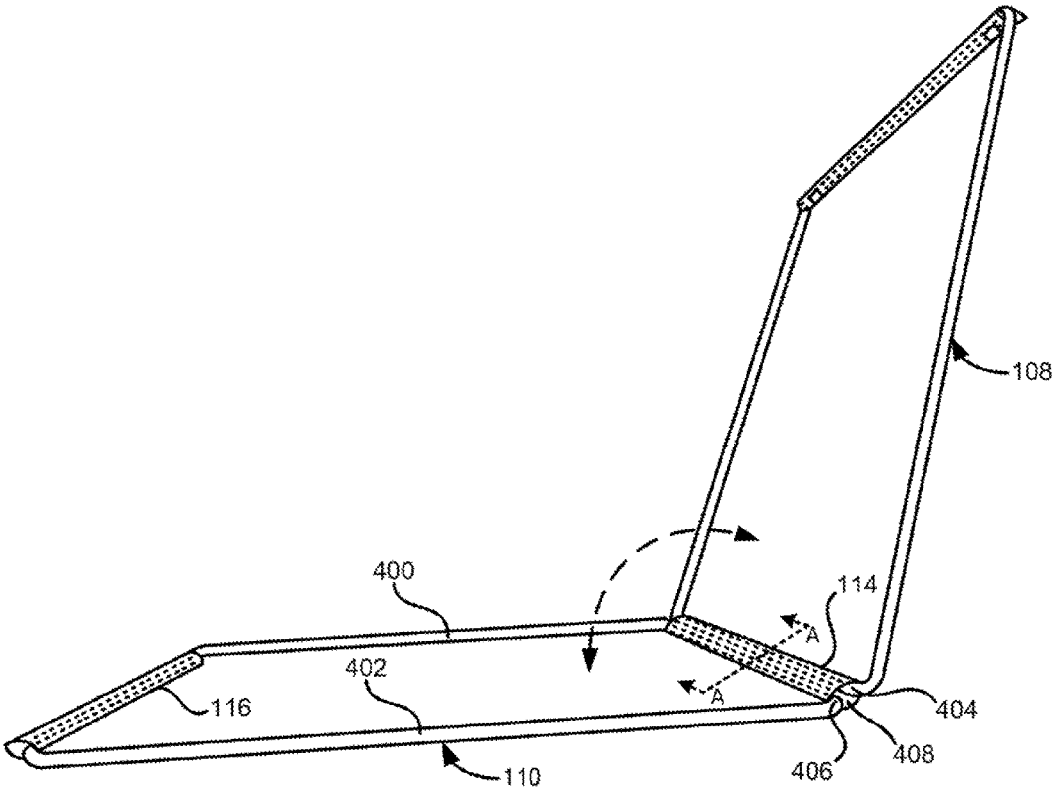
FIG. 4A illustrates an embodiment of two rectangular ladder frames of the agility ladder rotated with respect to one another.

FIG. 4A illustrates an embodiment of two rectangular ladder frames 102 of the agility ladder 100. The two rectangular ladder frames 102 can be any two neighboring or adjacent rectangular ladder frames 102. For example, the two rectangular ladder frames 102 can be the first ladder frame 108 and the second ladder frame 110 shown in FIG. 1.

As shown in FIG. 4A, the first ladder frame 108 can comprise a first ladder rung side 404. The second ladder frame 110 can comprise a first lateral side 400, a second lateral side 402, and a second ladder rung side 406.

The first ladder frame 108 can be connected to the second ladder frame 110 by the first rung sleeve 114. As depicted in FIG. 4A, the first rung sleeve 114 can have a rung lumen 408. The first rung sleeve 114 can connect the first ladder frame 108 to the second ladder frame 110 when at least part of the first ladder rung side 404 and at least part of the second ladder rung side 406 are within the rung lumen 408 of the first rung sleeve 114. The rung lumen 408 can have a lumen volume large enough to allow the first ladder frame 108 to rotate relative to the second ladder frame 110 or vice versa. Allowing each of the rectangular ladder frames 102 to rotate relative to one another can facilitate the folding of the agility ladder 100 into the stacked structure 200 (see FIG. 2B) and the quadrifolium configuration 512.

Figure 4B:
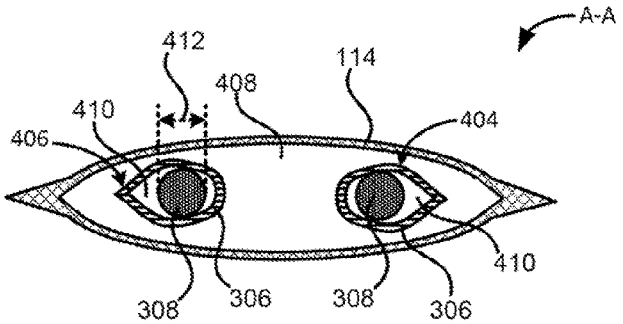
FIG. 4B is a side cross-sectional view of a portion of the agility ladder taken along line A-A in FIG. 4A.

FIG. 4B is a side cross-sectional view of a portion of the agility ladder 100 taken along line A-A in FIG. 4A. FIG. 4B illustrates that the rung lumen 408 can have enough space to accommodate the first ladder rung side 404 and the second ladder rung side 406. In addition, the rung lumen 408 can be sized such that there is enough empty space to allow the first ladder rung side 404 and the second ladder rung side 406 to rotate (either in a clockwise direction or a counterclockwise direction) within the rung lumen 408.

FIG. 4B also illustrates that the frame sleeve 306 can have a frame sleeve lumen 410 and the flexible wire frame 308 can have a wire diameter 412. As previously discussed, the flexible wire frame 308 can be housed within the frame sleeve lumen 410. As shown in FIG. 4B, the frame sleeve lumen 410 can be sized slightly larger than the wire diameter 412 to allow the flexible wire frame 308 to shift slightly within the frame sleeve 306. In some embodiments, the wire diameter 412 can be between approximately 1.5 mm and 2.0 mm. The excess space or volume provided by the rung lumen 408 and the frame sleeve lumen 410 allows the agility ladder 100 to twist and fold from the stacked structure 200 into the quadrifolium configuration 512.

Figure 5A:
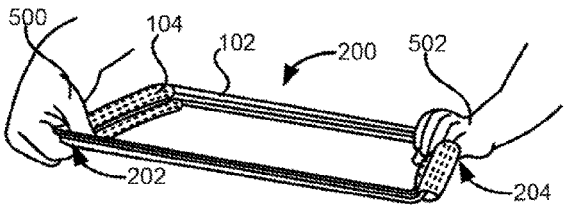
FIGS. 5A-5D illustrate example steps of a method of folding the agility ladder.

FIGS. 5A-5D illustrate steps of an example method of folding the agility ladder 100. FIG. 5A illustrates step 1 of the example method which involves gathering and folding the plurality of rectangular ladder frames 102 into the stacked structure 200. As can be seen in FIG. 5A, the agility ladder 100 can have a first stacked corner 202 and a second stacked corner 204 when folded into the stacked structure 200. A user can hold the first stacked corner 202 using one hand of the user (for example, the right hand 500). The user can also hold the second stacked corner 204 using the other hand of the user (for example, the left hand 502).

Figure 5B:
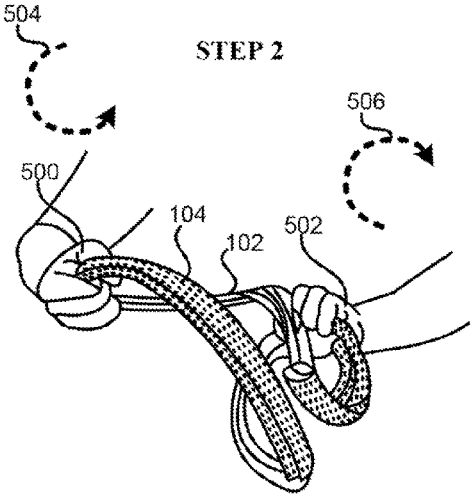

FIG. 5B illustrates that step 2 of the method can involve twisting the first stacked corner 202 in a first rotational direction 504 (for example, a clockwise direction), and simultaneously twisting the second stacked corner 204 in a second rotational direction 506 (for example, a counter-clockwise direction) opposite the first rotational direction 504. In an alternative embodiment, step 1 of the method can involve twisting the first stacked corner 202 in a first rotational direction 504 using one hand of the user (for example, the right hand 500) while simultaneously holding the second stacked corner 204 steady with the other hand of the user, for example, the left hand 502).

Figure 5C:
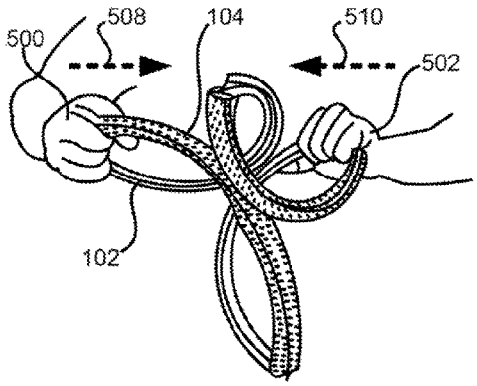

FIG. 5C illustrates that step 3 of the method can involve bringing the first stacked corner 202 closer to the second stacked corner 204. For example, the user can bring the first stacked corner 202 in a first lateral direction 508 and the second stacked corner 204 in a second lateral direction 510 toward the medial line of the user. As shown in FIG. 5C, the agility ladder 100 can begin to form into a quadrifolium shape as result of the aforementioned rotations and bringing the first stacked corner 202 closer to the second stacked corner 204.

Figure 5D:
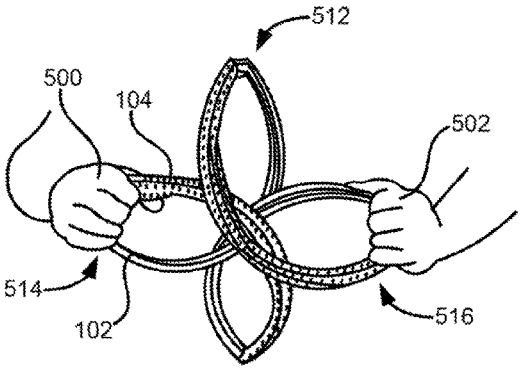

FIG. 5D illustrates that step 4 of the method of folding the agility ladder 100 can involve the agility ladder 100 achieving a quadrifolium configuration 512 when the flexible wire frames 308 within the frame sleeves 306 contort into a stable quadrifolium shape without spontaneously reverting back to their substantially rectangular shapes.

Although not shown in the figures, it is contemplated by this disclosure that a method of opening the agility ladder 100 folded into the quadrifolium configuration 512 can involve holding a first petal-shaped portion 514 of the folded agility ladder 100 with one hand of the user (for example, the right hand 500) and holding a second petal-shaped portion 516 of the folded agility ladder 100 with another hand of the user (for example, the left hand 502). The method can also involve twisting the first petal-shaped portion 514 in a first rotational direction 504 while simultaneously twisting the second petal-shaped portion 516 in a second rotational direction 506 or holding the second petal-shaped portion 516 steady. The user can also pull the first petal-shaped portion 514 away from the second petal-shaped portion 516 or by pulling both the first petal-shaped portion 514 and the second petal-shaped portion 516 away from a medial line of the user. The agility ladder 100 can revert back to the stacked structure 200 from the quadrifolium configuration 512 when the folded agility ladder 100 is opened in this manner.

One benefit of folding the agility ladder 100 into the quadrifolium configuration 512 is the speed with which a user can unwind or open the agility ladder 100 into a ladder configuration. In addition, the unique design of the agility ladder 100 including the plurality of rectangular ladder frames 102 (where each of the rectangular ladder frames 102 comprises a flexible wire frame 308 encased within a frame sleeve 306) connected by ladder rung sleeves 104 allows the agility ladder 100 to be folded into the quadrifolium configuration 512 and opened up from the quadrifolium configuration 512 without tangling the ladder rungs or ladder sides or getting the ladder rungs or ladder sides tied into knots.

Figure 6A:
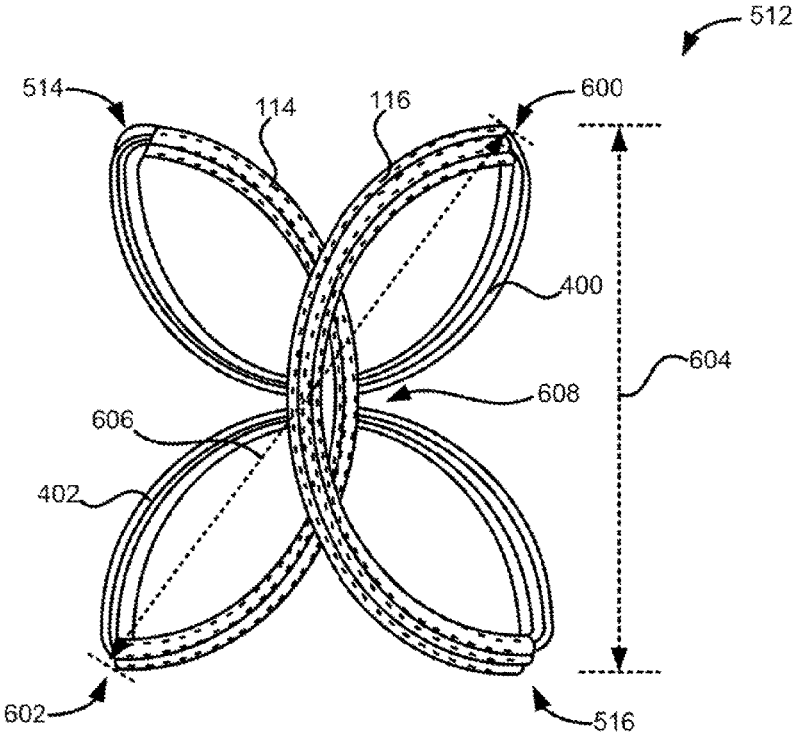
FIG. 6A is a top plan view of an embodiment of the agility ladder folded into a quadrifolium configuration.
Figure 6B:
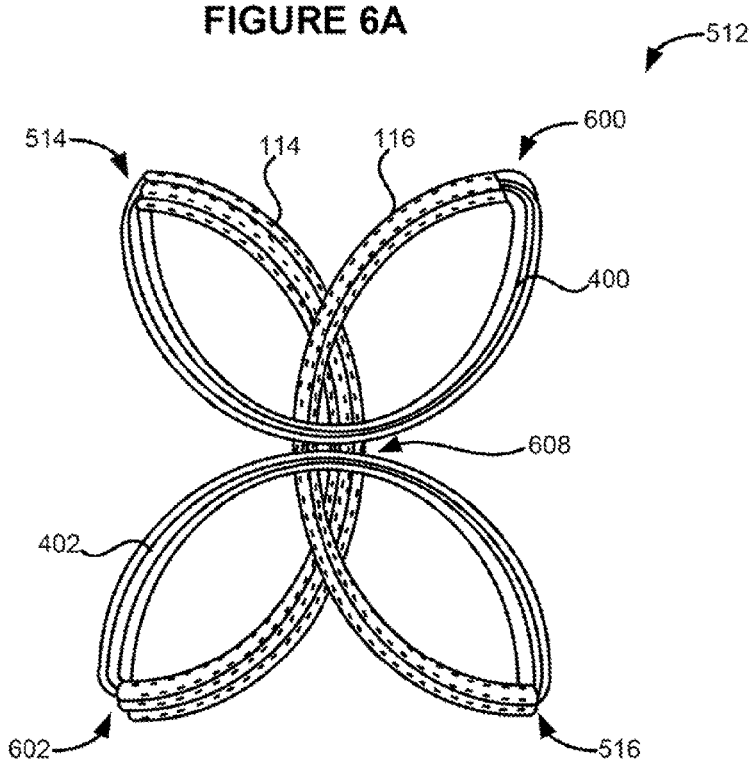
FIG. 6B is a bottom plan view of the agility ladder shown in FIG. 6A.

FIG. 6A is a top plan view of an embodiment of the agility ladder 100 folded into a quadrifolium configuration 512. FIG. 6B is a bottom plan view of the agility ladder 100 shown in FIG. 6A. The quadrifolium configuration 512 can be a folded configuration of the agility ladder 100 where the ladder rungs and the ladder lateral sides form the outline of a four-petal or four-leaf structure. The four-petal or four-leaf structure can also be referred to as a butterfly structure or shape.

As shown in FIGS. 6A and 6B, the agility ladder 100 folded into the quadrifolium configuration 512 can have a first petal-shaped portion 514, a second petal-shaped portion 516, a third petal-shaped portion 600, and a fourth petal-shaped portion 602. The first petal-shaped portion 514 can be substantially diagonal to the second petal-shaped portion 516. The third petal-shaped portion 600 can be substantially diagonal to the fourth petal-shaped portion 602.

As shown in FIGS. 6A and 6B, neighboring or adjacent ladder rung sleeves 104 can form different parts of the petal-shaped portions. For example, the first rung sleeve 114 can form at least part of the first petal-shaped portion 514 and at least part of the fourth petal-shaped portion 602. The second rung sleeve 116 can form at least part of the second petal-shaped portion 516 and at least part of the third petal-shaped portion 600.

In addition, the first lateral side 400 can form at least part of the first petal-shaped portion 514 and at least part of the third petal-shaped portion 600 when the agility ladder 100 is folded into the quadrifolium configuration 512. Moreover, the second lateral side 402 can form at least part of the second petal-shaped portion 516 and at least part of the fourth petal-shaped portion 602 when the agility ladder 100 is folded into the quadrifolium configuration 512. FIGS. 6A and 6B illustrate that the ladder rung sleeves 104 (including the first rung sleeve 114 and the second rung sleeve 116) and the lateral sides (including the first lateral side 400 and the second lateral side 402) can be curved or contorted into an arcuate or bowed shape when the agility ladder 100 is folded into the quadrifolium configuration 512.

As shown in FIG. 6A, the agility ladder 100 folded into the quadrifolium configuration 512 can also have a quadrifolium height 604 and a quadrifolium diagonal length 606. In some embodiments, the quadrifolium height 604 can be between approximately 260 mm to 280 mm. In these and other embodiments, the quadrifolium diagonal length 606 can be between approximately 350 mm to 360 mm.

In some embodiments, a ratio of the frame diagonal length 302 to the quadrifolium diagonal length 606 can be between approximately 1.4:1 to 1.6:1. In these and other embodiments, a ratio of the frame side length 300 to the quadrifolium height 604 can be between approximately 1.5:1 to 1.8:1. It should be understood by one of ordinary skill in the art that the aforementioned dimensions can vary as the overall size of the agility ladder 100 and the rectangular ladder frames 102 increase or decrease.

FIG. 6A also illustrates that the agility ladder 100 in the quadrifolium configuration 512 can also have a central region 608 where neighboring or adjacent ladder rung sleeves 104 cross or overlap. For example, as can be seen in FIG. 6A, the central region 608 can comprise at least a portion of the first rung sleeve 114 overlapping or crossing with a portion of the second rung sleeve 116. FIG. 6B illustrates that in one example embodiment the opposing lateral sides (for example, the first lateral side 400 and the second lateral side 402) of the agility ladder 100 do not cross or overlap in the central region 608 even though the ladder rung sleeves 104 cross or overlap. In other embodiments not shown in the figures, the opposing lateral sides can cross or overlap in the central region 608.

Figure 7A:
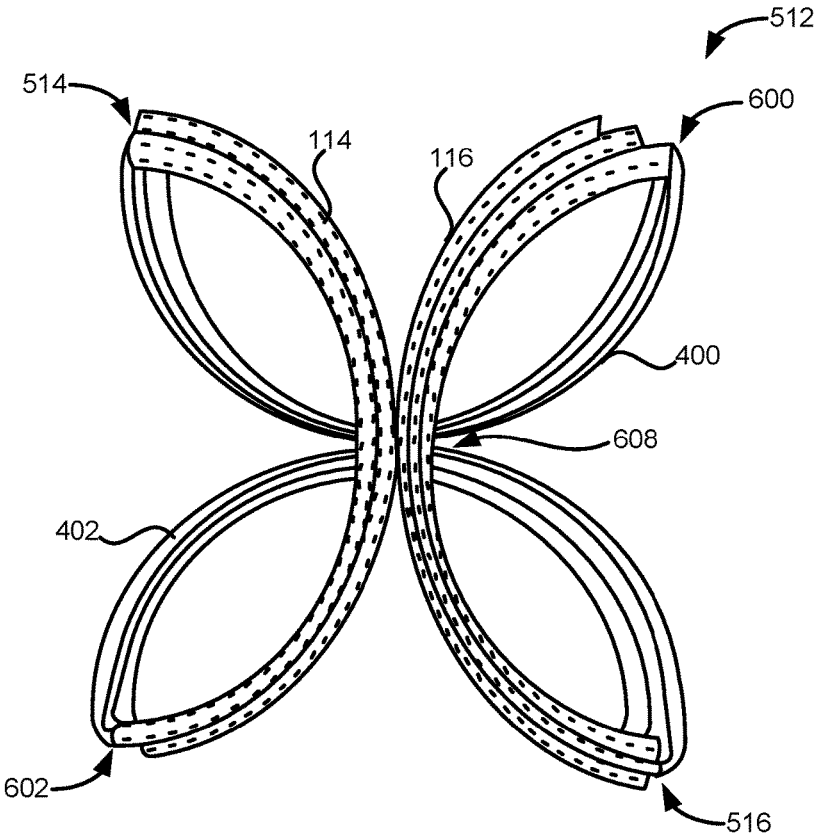
FIG. 7A is a top plan view of another embodiment of the agility ladder folded into the quadrifolium configuration.
Figure 7B:
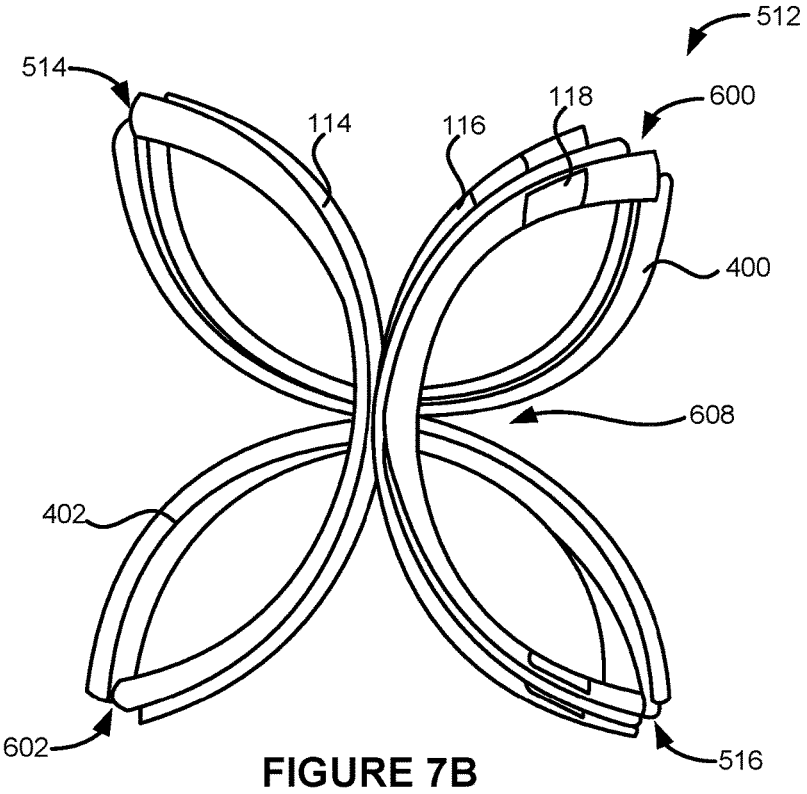
FIG. 7B is a black-and-white image of an embodiment of the agility ladder.

FIG. 7A is a top plan view of another embodiment of the agility ladder 100 folded into the quadrifolium configuration 512. FIG. 7B is a black-and-white image of another embodiment of the agility ladder 100 folded into the quadrifolium configuration 512. FIGS. 7A and 7B illustrate that in these embodiments of the agility ladder 100, the ladder rung sleeves 104 do not overlap or cross at the central region 608.

Figure 7C:
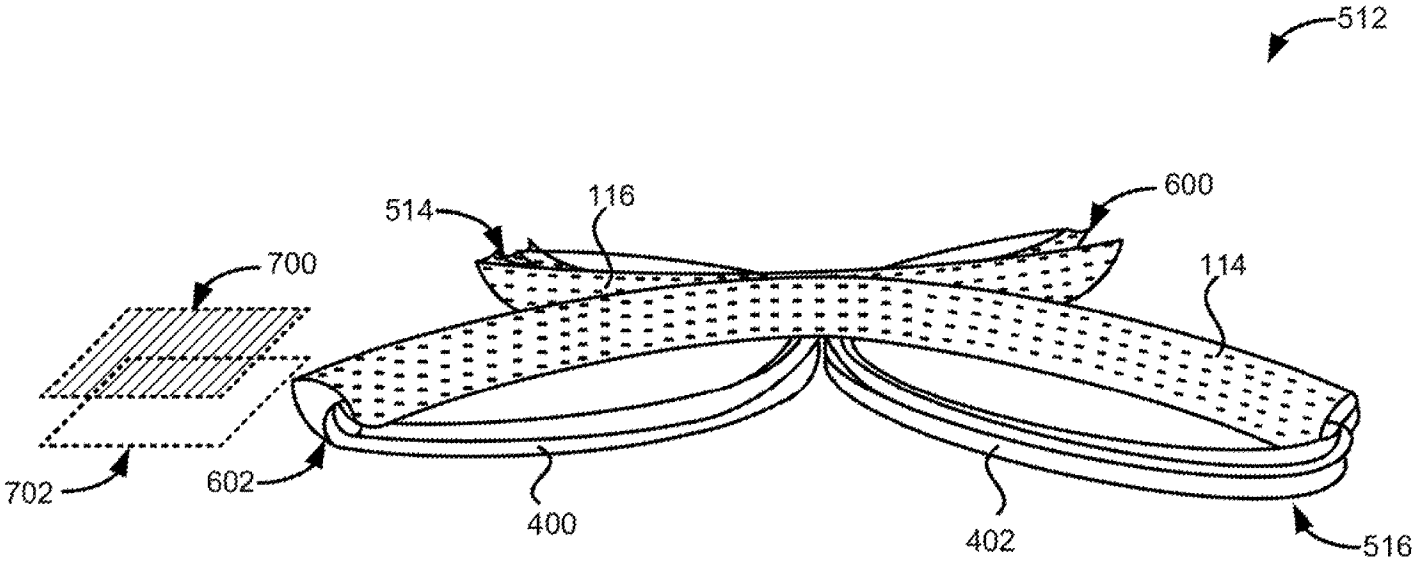
FIG. 7C is a side view of the agility ladder shown in FIG. 7A.

FIG. 7C is a side view of the agility ladder 100 shown in FIG. 6A. FIG. 7C illustrates that the curved ladder rung sleeves 104 making up parts of the quadrifolium configuration 512 can be arranged or aligned substantially in one two-dimensional orientation plane spatially offset from the curved lateral sides of the agility ladder 100, which are also arranged or aligned substantially in their own two-dimensional orientation plane. For example, as shown in FIG. 7C, at least part of the ladder rung sleeves 104 (including the first rung sleeve 114 and the second rung sleeve 116) can be substantially spatially aligned in a ladder rung plane 700. Also, for example, at least part of the lateral sides (including the first lateral side 400 and the second lateral side 402) can be substantially spatially aligned in a lateral side plane 702. FIG. 7C shows that the ladder rung plane 700 can be offset (or separated by a distance) from the lateral side plane 702. In one example embodiment, the ladder rung plane 700 can be substantially parallel to the lateral side plane 702.

Figure 8A:
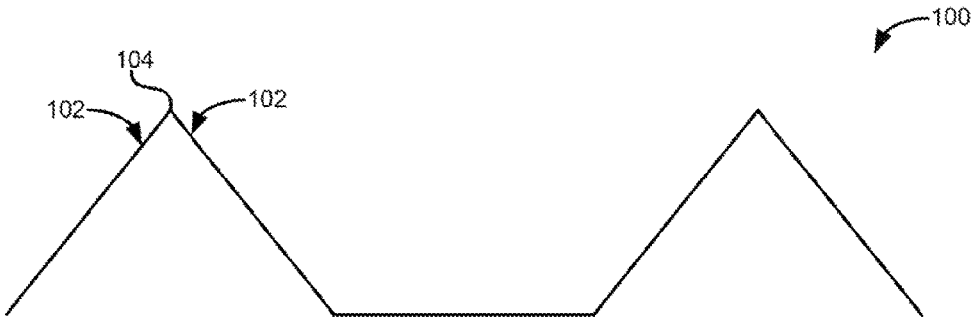
FIG. 8A is a schematic illustration of an embodiment of the agility ladder set up as a combined agility ladder and hurdling obstacle when viewed from the side.

FIG. 8A is a schematic illustration of an embodiment of the agility ladder 100 viewed from the side. As shown in FIG. 8A, an agility ladder 100 having five rectangular ladder frames 102 can be set up as a combined agility ladder 100 and hurdling obstacle. For example, as depicted in FIG. 8A, two ladder rung sleeves 104 can be raised such that the two rectangular ladder frames 102 connected by each of the two ladder rung sleeves 104 can be inclined or positioned at an angle with respect to one another. In this way, the two rectangular ladder frames 102 can form a steeple or hurdle structure with the ladder rung sleeves 104 serving as the top of the steeple or hurdle.

Figure 8B:
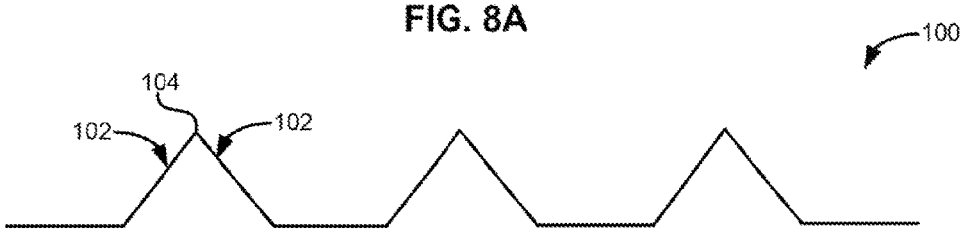
FIG. 8B is a schematic illustration of an embodiment of the agility ladder set up as a combined agility ladder and hurdling obstacle when viewed from the side.

FIG. 8B is a schematic illustration of another embodiment of the agility ladder 100 viewed from the side. As shown in FIG. 8B, an agility ladder 100 having ten rectangular ladder frames 102 can also be set up as a combined agility ladder 100 and hurdling obstacle. An athlete or trainee can use the agility ladder 100, arranged as shown in either FIG. 8A or FIG. 8B, to do both agility and hurdling training exercises.

Figure 8C:
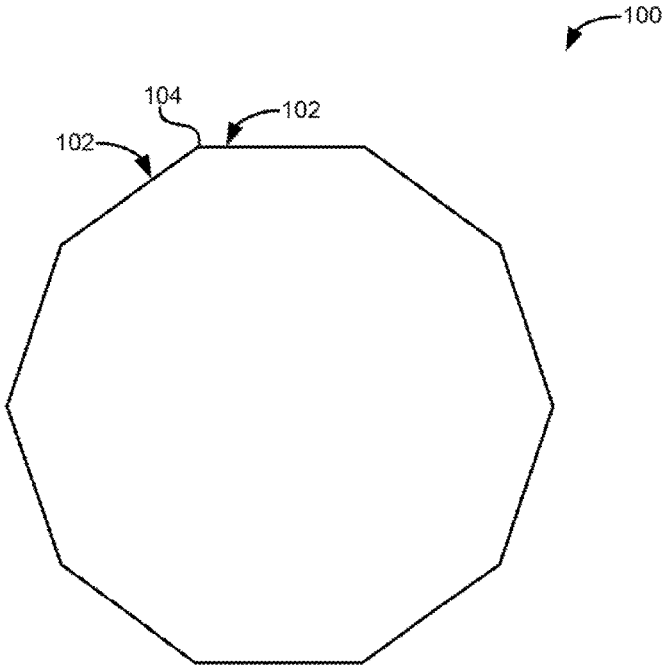
FIG. 8C is a schematic illustration of another embodiment of the agility ladder arranged as a jumping obstacle when viewed from the top.

FIG. 8C is a schematic illustration of an embodiment of the agility ladder 100 arranged as a jumping obstacle. In this embodiment, an agility ladder 100 having ten rectangular ladder frames 102 can be placed on its side so as to form a ten-sided or decagonal jumping obstacle. An athlete or trainee can use the agility ladder 100 arranged in this manner to do jumping exercises or vertical leap training exercises. Another advantage of the agility ladder 100 disclosed herein is the ability of the agility ladder 100 to transform into a combination agility ladder 100 and hurdling obstacle or jumping obstacle as shown in FIGS. 8A-8C.

Each of the individual variations or embodiments described and illustrated herein has discrete components and features which may be readily separated from or combined with the features of any of the other variations or embodiments. Modifications may be made to adapt a particular situation, material, composition of matter, process, process act(s) or step(s) to the objective(s), spirit or scope of the present invention.

Methods recited herein may be carried out in any order of the recited events that is logically possible, as well as the recited order of events. Moreover, additional steps or operations may be provided or steps or operations may be eliminated to achieve the desired result.

Furthermore, where a range of values is provided, every intervening value between the upper and lower limit of that range and any other stated or intervening value in that stated range is encompassed within the invention. Also, any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

Reference to a singular item includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise, all technical and scientific terms used herein have the same meaning as commonly understood by one of ordinary skill in the art to which this invention belongs.

This disclosure is not intended to be limited to the scope of the particular forms set forth, but is intended to cover alternatives, modifications, and equivalents of the variations or embodiments described herein. Further, the scope of the disclosure fully encompasses other variations or embodiments that may become obvious to those skilled in the art in view of this disclosure.

I claim:

1. An agility ladder, comprising:

a plurality of rectangular ladder frames, wherein the plurality of rectangular ladder frames comprise:

a first ladder frame, a second ladder frame, and a third ladder frame;

a plurality of ladder rung sleeves connecting the plurality of rectangular ladder frames to each other, wherein each of the plurality of ladder rung sleeves connects a respective two of the plurality of rectangular ladder frames together, wherein the plurality of ladder rung sleeves comprise a first rung sleeve and a second rung sleeve, wherein the first rung sleeve connects the first ladder frame to the second ladder frame, wherein the second rung sleeve connects the second ladder frame to the third ladder frame;

wherein the agility ladder has a quadrifolium configuration when the agility ladder is folded and the quadrifolium configuration comprises four petal-shaped portions including a first petal-shaped portion, a second petal-shaped portion, a third petal-shaped portion, and a fourth petal-shaped portion; and wherein the first rung sleeve forms at least part of the first petal-shaped portion and at least part of the fourth petal-shaped portion and wherein the second rung sleeve forms at least part of the second petal-shaped portion and at least part of the third petal-shaped portion.

2. The agility ladder of claim 1, wherein each of the plurality of rectangular ladder frames comprises a flexible wire frame covered by a frame sleeve.

3. The agility ladder of claim 2, wherein the flexible wire frame is one continuous steel wire shaped substantially as a rectangle.

4. The agility ladder of claim 3, wherein the one continuous steel wire has a wire diameter between 1.5 mm to 2.0 mm.

5. The agility ladder of claim 3, wherein the one continuous steel wire is high carbon steel wire.

6. The agility ladder of claim 2, wherein the frame sleeve is made from a synthetic fabric.

7. The agility ladder of claim 2, wherein the frame sleeve has a sleeve frame lumen and the flexible wire frame is within the sleeve frame lumen.

8. The agility ladder of claim 1, wherein each of the plurality of ladder rung sleeves comprises a rung lumen, wherein the first ladder frame comprises a first ladder rung side and the second ladder frame comprises a second ladder rung side, wherein the first rung sleeve connects the first ladder frame to the second ladder frame when at least part of the first ladder rung side and at least part of the second ladder rung side are within the rung lumen of the first rung sleeve.

9. The agility ladder of claim 8, wherein the first ladder frame is rotatable relative to the second ladder frame when the first rung sleeve connects the first ladder frame to the second ladder frame.

10. The agility ladder of claim 1, wherein the first ladder frame comprises a first lateral side and a second lateral side, wherein the first lateral side forms at least part of the first petal-shaped portion and at least part of the third petal-shaped portion.

11. The agility ladder of claim 1, wherein the plurality of rectangular ladder frames further comprise an additional one to seven ladder frames.

12. The agility ladder of claim 1, wherein the plurality of ladder rung sleeves are made from a synthetic fabric.

13. The agility ladder of claim 1, wherein the plurality of rectangular ladder frames are square-shaped ladder frames.

14. The agility ladder of claim 1, wherein each of the plurality of rectangular ladder frames has four rounded corners.

15. The agility ladder of claim 1, wherein each of the plurality of rectangular ladder frames has a frame diagonal length and the agility ladder in the quadrifolium configuration has a quadrifolium diagonal length, wherein a ratio of the frame diagonal length to the quadrifolium diagonal length is between 1.4:1 to 1.6:1.

16. The agility ladder of claim 1, wherein each of the plurality of rectangular ladder frames has a frame side length and the agility ladder in the quadrifolium configuration has a quadrifolium height, wherein a ratio of the frame side length to the quadrifolium height is between 1.5:1 to 1.8:1.

17. The agility ladder of claim 1, wherein the agility ladder is foldable into a stacked structure where the plurality of rectangular ladder frames are stacked on top of one another.

18. A method of folding an agility ladder comprising:

folding a plurality of rectangular ladder frames into a stacked structure, wherein the stacked structure comprises a first stacked corner and a second stacked corner diagonal to the first stacked corner;

twisting the first stacked corner in a first rotational direction; and simultaneously holding the second stacked corner steady or twisting the second stacked corner in a second rotational direction opposite the first rotational direction to fold the agility ladder into a quadrifolium configuration.

19. The method of claim 18, further comprising bringing the first stacked corner closer to the second stacked corner to further fold the agility ladder into the quadrifolium configuration.

20. A method of opening an agility ladder comprising:

providing the agility ladder, wherein the agility ladder comprises:

a plurality of rectangular ladder frames and a plurality of ladder rung sleeves connecting the plurality of rectangular ladder frames to one another, wherein the agility ladder has a quadrifolium configuration when the agility ladder is folded and the quadrifolium configuration comprises four petal-shaped portions comprising at least a first petal-shaped portion and a second petal-shaped portion;

twisting the first petal-shaped portion in a first rotational direction; and simultaneously holding the second petal-shaped portion steady or twisting the second petal-shaped portion in a second rotational direction opposite the first rotational direction.

* * * * *